US006712398B1

(12) United States Patent
Fox et al.

(10) Patent No.: US 6,712,398 B1
(45) Date of Patent: Mar. 30, 2004

(54) REMOVABLE INSERT ASSEMBLIES AND METHODS FOR MAKING

(75) Inventors: Henry J. Fox, Harleysville, PA (US); Harold D. Brooks, Jr., Coopersburg, PA (US)

(73) Assignee: Fox Bindery, Inc., Quakertown, PA (US)

( * ) Notice: Subject to any disclaimer, the term of this patent is extended or adjusted under 35 U.S.C. 154(b) by 20 days.

(21) Appl. No.: 10/251,147

(22) Filed: Sep. 20, 2002

(51) Int. Cl.[7] ..... B42D 15/00

(52) U.S. Cl. ..... 283/101; 40/606; 206/232; 281/15.1; 281/38; 283/61; 283/81; 428/42.3

(58) Field of Search ..... 283/81, 61, 62, 283/56, 101, 107; 206/232; 40/606; 281/2, 3.1, 5, 75.1, 38; 428/40.1, 42.3

(56) References Cited

U.S. PATENT DOCUMENTS

| | | | | | |
|---|---|---|---|---|---|
| 3,826,422 | A | * | 7/1974 | Dickinson | 229/68.1 |
| 4,551,373 | A | | 11/1985 | Conlon | |
| 5,141,252 | A | * | 8/1992 | Michlin | 281/15.1 |
| 5,263,743 | A | | 11/1993 | Jones | |
| 5,269,563 | A | * | 12/1993 | Michlin | 281/15.1 |
| 5,419,587 | A | * | 5/1995 | McClure et al. | 283/56 |
| 5,439,721 | A | | 8/1995 | Pedroli et al. | |
| 5,458,374 | A | | 10/1995 | Vijuk et al. | |
| 5,568,942 | A | * | 10/1996 | Stevens | 283/56 |
| 5,587,222 | A | | 12/1996 | Hoffmann | |
| 5,590,912 | A | * | 1/1997 | Stevens | 283/56 |
| 5,738,382 | A | | 4/1998 | Grosskopf et al. | |
| 5,813,700 | A | | 9/1998 | Vijuk et al. | |
| 6,027,780 | A | | 2/2000 | Treleaven et al. | |
| 6,045,160 | A | * | 4/2000 | Weeks | 281/29 |
| 6,057,019 | A | | 5/2000 | Barry | |
| 6,068,115 | A | | 5/2000 | Boulton | |
| 6,095,565 | A | * | 8/2000 | Kramer | 281/42 |
| 6,158,778 | A | | 12/2000 | Vijuk et al. | |
| 6,179,335 | B1 | | 1/2001 | DeLise, Jr. | |
| 6,270,121 | B1 | | 8/2001 | Dolan et al. | |
| 6,290,796 | B2 | | 9/2001 | Furst et al. | |
| 6,306,476 | B1 | | 10/2001 | Barry | |

* cited by examiner

*Primary Examiner*—Monica S. Carter
(74) *Attorney, Agent, or Firm*—Duane Morris LLP

(57) ABSTRACT

A substrate such as a promotional brochure or product container is provided with an insert holder. A preferably transparent an oversheet is attached to the substrate over an insert such as a folded product information sheet. The oversheet is affixed directly to the substrate by adhesive around a peripherally surrounding the insert, at lest on two opposite margins or edges straddling the insert. A zone is defined on the oversheet over the insert where the oversheet is nonadhesive. The oversheet can capture an inserted item, such as a folded product information sheet, which is intended to be extracted by a consumer by tearing away a portion of the oversheet or by laterally extracting the insert. The oversheet preferably is substantially clear and the edge strips are perforated. A process is disclosed wherein the oversheet provided on a label roll with a killed adhesive zone, and is applied on a production line using a label applicator and series of rollers.

14 Claims, 3 Drawing Sheets

REMOVABLE INSERT ASSEMBLIES AND METHODS FOR MAKING

FIELD OF THE INVENTION

The invention is directed to an assembly of a label and a substrate, and to a method for making it, wherein the label assembly has an oversheet attached peripherally to the substrate so as to define a zone between the oversheet and the substrate. The oversheet can capture an inserted item such as a folded product information sheet, which is intended to be extracted by a consumer who tears away a portion of the oversheet. The oversheet preferably is substantially clear and is attached at perforated edge strips to the substrate. The assembly is useful for providing product information to consumers, for example as an attachment to a product, package, promotional handout, ad in a publication, etc.

BACKGROUND OF THE INVENTION

Insert-receiving label assemblies can be useful in a number of situations in which a supplemental item needs to be carried on a substrate. The substrate might be a product or product container. The substrate could also be a sheet such as a printed promotional brochure or mailing. The insert might be a small product sample, a supplemental publication or instructional sheet, etc.

Supplemental publications or instructional sheets are particularly useful for distribution with or in connection with regulated products such as medicines, pesticides, potentially poisonous or dangerous substances and the like. These products may have extensive associated warnings, contraindications, instructions for use, instructions for amelioration of accidents, and the like. Even with relatively small print, the printed area that is needed for copies of the instructions, warnings and the like, might take more space than the entire surface area of the product packaging or the product promotional material involved. It is undesirable to obscure a product brochure or a product package wholly with cautionary information or this type.

For these and similar products, a folded up printed item advantageously is packaged and distributed together with the products and/or is affixed as some sort of addendum to promotional pieces. In the case of promotional pieces (e.g., mailings, magazine pages, handouts), the promotional piece may typically be a brightly printed glossy advertisement with pictures and logos. The informational material may typically be a black-and-white printed portion with small font size, either placed in an inner part of the advertisement (e.g., at the end) or contained in one or more separate sheets that are included. One technique is adhesively to attach envelope-like packages to the promotional pieces, the packages containing the warning sheet as a folded insert. The user tears open the envelope to obtain access to the insert.

Apart from inserts in envelopes affixed to printed promotional sheets and mailings, a similar supplemental item can be affixed to products or their packages, such as consumer products. Inserts are apt for product packages for the same reasons as above, namely to provide printed information that cannot advantageously be printed on the product or the container for the product.

Pharmaceutical products that are sold over the counter generally have some associated warnings and often are sold as vials or other containers packaged in boxes together with patient information inserts in the form of folded paper printed sheets. Frequently, such an information sheet or brochure is discarded with the box when the container is removed from the box. As a result, if a need for detailed information arises later, the printed sheets are no longer available.

Several ways are known to attach a detailed information sheet or leaflet as described, to a product container. The attachment could be more or less permanent, depending on expectations for how it will be used. Once the information sheet or leaflet is detached, and assuming there is no outer container or box, it is likely that the information sheet will be permanently separated from the product and lost.

Some similar problems are confronted with respect to product information sheets that are used with advertising brochures. Such brochures are used as handouts, mailings and the like. They are advantageously composed and printed in bright and attractive colors. They are advantageously associated with detailed information sheets or leaflets in small print, containing warnings that are perhaps necessary but that detract from the appearance of the brochure. U.S. Pat. No. 6,270,121 discloses a brochure with a removably attached product information patch for containing such an information sheet or leaflet. The product information patch consists of a base label that has adhesive applied over its surface facing the brochure, whereby the base label is permanently affixed to the brochure. A small-print folded product information sheet is contained between this base label and an over-laminated cover sheet. The folded product information sheet is spaced inwardly from the outer edges of the base label. The over-laminated sheet is secured to the base label over the product information sheet and adheres to the base label between the outer edges of the base label and the product information sheet.

The foregoing structure forms a closed envelope containing the product information sheet, affixed flat on the surface of the brochure. (Presumably it could likewise be affixed on the surface of a product or product package.) The over-laminate sheet can have perforations on opposite sides of the product information sheet. To obtain access to the product information sheet, the user tears the over-laminate apart at the perforations and extracts the product information sheet, leaving the base layer and any undetached portions of the over-laminate attached to the primary substrate, in this case a promotional brochure. The base layer typically remains attached to the substrate, as does at least the peripheral part of the over-laminate, after the product information sheet has been extracted. Separation of the over-laminate at the perforations generally removes any structure that could hold the product information sheet to the base label, so the envelope is only useful until the product information sheet is first removed. Normally that is sufficient for a product information sheet with a promotional brochure because after review of the brochure, and optionally also the product information sheet, the brochure and information sheet are both usually discarded.

It may seem complicated to have a base layer, a product information sheet and a perforated over-laminate attached to the brochure or other substrate, when one might simply glue an edge of the product information sheet to the product. However, there are some structural advantages to having the folded information sheet captured in a flat package. In addition to preventing the information sheet from unfolding inadvertently, a continuous web of such flat packages can be made and the roll can be handled substantially the same as a roll of mailing labels. The flat packages can be fed from the roll onto the brochures, such that an adhesive bearing side of each package is placed against and adheres to the surface of an associated brochure.

Each flat package in U.S. Pat. No. 6,270,121, as described above, has two distinct sheets affixed together from opposite faces of the product information sheet. It is also possible to use one integral sheet in a similar manner, except to fold the integral sheet to form one of the edges of the flat package. That structure could potentially avoid the need for a glue joint at the fold, but without any adhesive would need some functionally similar attention (e.g., hot rolling along the edge) to form a crisp flat fold.

More complicated envelopes are also known, wherein there are additional web layers, glue joints that extend part way across the area of contact between web layers, joints that are intended to capture just an extreme edge of a product information sheet and so forth. However it would be advantageous if product of this type could be improved, potentially even to simplify them, without contributing to the complexity of their structure and use.

U.S. Pat. No. 5,587,222 discloses an exemplary label assembly that includes a removable multi-ply insert and is likewise complex. The assembly includes a label that has adhesive applied to one side, and a removable multi-ply insert attached to the label by at least one fastening strip. The fastening strip may be permanently secured to the label at an end, and secured to the label by a peelable adhesive at the other end. A multi-ply insert of this type might be reattached to the label, although with continued removal and reinsertion, the structural parts and adhesive relations could weaken.

There is a need for new and improved labels and methods for labeling of products whereby a removable item such as a folded product information sheet can be affixed to a product such as an advertising brochure, can capture and hold the removable item securely but permit it to be accessed readily without substantial damage to the underlying substrate, and that can be manufactured without excessive cost. The present invention is directed to these and other important ends.

SUMMARY OF THE INVENTION

These needs are solved according to an inventive concept by providing a way to apply an over-laminate sheet directly to the underlying substrate in a way that facilitates handling of the over-laminate sheet as a label, does not glue or at most only incidentally tacks the removable item, such as a folded product information sheet, to the substrate, and facilitates access to the inserted item by separating the over-laminate, without damaging the substrate, for example, due to pulling apart adhesively affixed layers.

In one aspect, the invention provides an insert label assembly having a substrate, an insert, and a substantially transparent oversheet. The oversheet is preferably but not necessarily rectangular, and has spaced edges straddling the insert. The insert is disposed between the substrate and the oversheet, and the oversheet is affixed to the substrate at least at two of the spaced edges.

The insert may be removable from between the substrate and the oversheet while the oversheet remains intact and/or affixed to the substrate. Alternatively the oversheet can be made to tear away. The insert can be a leaflet bearing text or images, which is apt for containing supplemental product information, such as warnings and detailed instructions for medicinal products, etc. In other embodiments, the insert can be a product or a device such as, for example, a sample of a consumer product contained in a packet and affixed to the assembly between the oversheet and the substrate.

In an embodiment wherein the oversheet is more or less rectangular in shape, namely having two pairs of opposing mutually perpendicular edges, the oversheet can be affixed to the substrate exclusively at one pair of the opposing edges, leaving one or both of the perpendicular pair edges unattached so as to form a pocket with one access edge or a banded-over retaining structure with two edges open. The oversheet can be an arbitrary shape, for example complementary with an arbitrarily shaped product, with the attached edges defining a whole or partial enclosure, a curve such as a U-shape with an open top edge and a closed U-shaped bottom edge, etc.

Conveniently, the oversheet is substantially rectangular in shape, and can have rounded corners. The oversheet has a pair of opposing side edges, a top edge, and a bottom edge, and is affixed to the substrate at the pair of opposing side edges. To improve the likelihood of retention of the insert, the oversheet can also be attached at the bottom edge. The top edge is not attached to the substrate, thereby providing an open-ended pocket.

To improve retention of the insert, a relatively light adhesive material can additionally be placed between the insert and the substrate or between the insert and the oversheet, or both. This tacking adhesive is limited in coverage area and adhesion force (tackiness) so that the insert is removably adhered to the substrate by the adhesive material, and there is little or no visible damage to the insert or to the substrate when the insert is removed.

A number of specific arrangements are possible wherein the insert is more or less securely adhered. Generally, design choices that improve the security of retention increase the need to tear the oversheet when removing the insert. This can be facilitated by perforating the oversheet in one or more defined areas such as spaced lines along opposite edge strips of the oversheet that are adhered to the substrate. The perforations are disposed between the adhered edge strips and a central area that is not adhered or provided with an active adhesive layer.

Another aspect of the invention is a method for manufacturing an insert label assembly, whereby the oversheet can be handled much like a mailing label, but when applied forms a partial pocket for neatly retaining a folded paper insert or the like. A substrate is provided, to which the insert will be affixed, and in a preferred finishing line application, a succession of substrates are fed along a conveyor line. A supply of inserts is likewise provided, for example in a feed magazine. Each insert has a back surface, a front surface, and at least three edges. In a preferred arrangement the insert is a folded paper information sheet, but other sorts of inserts such as product samples are also possible and useful.

The substrates are fed along a conveying path passing a feed outlet from the magazine, and each receives an insert from the magazine. One or more of the inserts are deposited directly against the substrate from one or more magazines, such that a back surface of the insert contacts the substrate. After placing the insert on the substrate, an oversheet is likewise placed onto the substrate, at least partly over the insert. The oversheet has a top surface and a bottom surface, and a portion of the oversheet extends beyond at least two of the edges of the insert. Thus the bottom surface of the oversheet is applied over the insert and extends beyond the edges of the insert, or straddles the insert, at edges of the oversheet that contact the substrate directly.

In preferred embodiments, the oversheet has a first adhesive material on its bottom surface facing toward the substrate and the insert. In a particularly preferred embodiment, the oversheet is a transparent plastic sheet taken from a roll of labels whereby the successive oversheets for successive inserts are lifted from a web by a label feeder and rested on and straddling over the insert.

The first adhesive material on the underside of the oversheet may be a permanent adhesive. The insert optionally is removably affixed to the substrate by a second adhesive material that is less permanent or at least less tacky.

In another preferred embodiment, the first adhesive on the bottom surface of the oversheet is applied substantially over the entire bottom surface of the oversheet when preparing the oversheet on a label web. However, in selected areas of each individual oversheet label or patch, specifically in a central area spaced from the edges, the first adhesive on the bottom surface of the oversheet is deactivated or "killed." More particularly, the deactivated area can be chemically treated or coated so as to eliminate the tackiness of the adhesive, or to remove or to cover over the tacky adhesive, in a defined area to be disposed over the insert.

These and other embodiments of the invention will be apparent to those skilled in the art in view of the ensuing disclosure, the appended claims, and the drawings, wherein the same reference numbers have been used to identify corresponding items in the respective views. It should be appreciated, however, that in this description, a number of the terms employed to describe orientations or directions such as "top" and "bottom" and "upper" and "lower," etc., are used for only convenience in describing the embodiments shown in the drawings being discussed. These terms are not intended to limit the invention to a particular orientation, or unless otherwise apparent, to exclude arrangements, including those having additional elements above a defined top or below a defined bottom, etc.

DETAILED DESCRIPTION OF PREFERRED EMBODIMENTS

Figure 1:
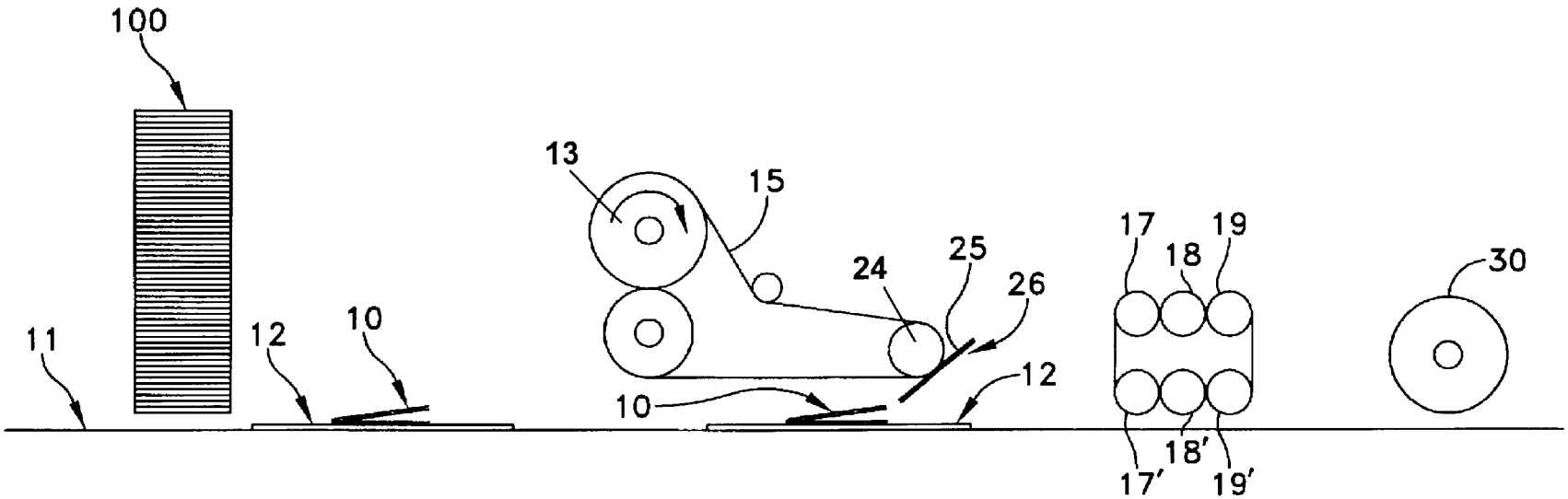
FIG. 1 is a schematic side view of a process for making insert label assemblies according to one embodiment of the invention.

The invention is described with respect to a preferred application for insert label assemblies wherein supplemental printed information is affixed to printed promotional stock as the substrate. This particular application, which should be regarded as a nonlimiting, is an advantageous type of assembly. However the invention is applicable to various situations wherein an article to be inserted and the substrate are supplied as a unit. In the example of supplemental printed information, the insert needs to be attached durably yet inexpensively, while facilitating the ability of the ultimate user to obtain access, when and if desired. Such insert label assemblies are useful in labeling products such as consumer products and the like. The insert assemblies allow inserts to be attached to the outside of such products, such as on their packaging materials, and removed without substantial difficulty by a user. The insert label assemblies are also useful for providing information to a potential user, such as a consumer or patient, apart from direct association with a supply of a particular product.

An insert assembly includes a substrate, a insert, and an oversheet. The substrate may be a product, a package for a product, or a substrate intended solely or substantially for use in connection with the insert such as, for example, a promotional brochure, poster or placard. Products for which the insert assembly is useful include consumer products, pharmaceutical products, products for use in a laboratory or manufacturing location and the like. The insert may be a leaflet bearing printed information such as information for a patient or a physician, e.g., dosage information, indications and contraindications, operating instructions, potential interaction warnings, or other text, as well as illustrations and/or diagrams.

In an alternative embodiment, instead of or in addition to an informational leaflet, the insert assembly can include a product sample or a product for purchase. Examples of products that may be provided in the assemblies instead of or in combination with a leaflet include pharmaceutical products such as one or more individual dosages of a medication; cosmetic products such as lotions, soaps, and shampoos; and miscellaneous products such as refrigerator magnets, pins or buttons, coins, etc. The product can be unwrapped or may be contained in a suitable container, such as, for example, an envelope, a packet such as a foil packet, a glass or plastic ampoule, or a bag.

It is possible to embody the assembly of the invention such that the insert is attached to the substrate in a way that permits the insert to be removed from the substrate without irreversibly altering or damaging the insert assembly, and potentially so that the insert can be replaced into the assembly after use. The insert can be supplementally affixed directly to the substrate, such a product package, by an adhesive. The insert and the substrate together can be attached to as a unit to a product container or other item, or distributed separately.

It is possible to arrange the assembly to permit the insert to be removed and replaced one or more times. For such removable attachment, a non-permanent adhesive material or a lightly tacky adhesive may be disposed on one surface of the insert, and the oversheet covering the insert can surround and enclose the insert only partially. Alternatively, a one-time use may be envisioned whereby after an initial access the insert and/or substrate is discarded. In that case, it is possible to permit the oversheet to become damaged in obtaining access to the insert.

For removable tacking attachment of the insert, whether or not reattachment of the insert to the substrate is desired, a non-permanent adhesive may be used. Suitable non-permanent adhesives include fugitive hot melts (temporary rubber cements), which do not cure and can affix two suitable surfaces together with a relatively low tackiness as compared to some other forms of more permanent adhesive. Thus, preferably, when the insert is removed from the assembly, the substrate is not damaged. In the context of a printed brochure as the substrate, "damage" is construed to mean any lingering visible effect from the adhesive, such as the pulling of fibers from the substrate, discoloration or the like, which generally are avoided by relying instead on the oversheet for retention of the insert.

The oversheet is dimensioned such that two or more margins or edge strips extend beyond the insert and are brought into contact with the surface of the substrate laterally adjacent to the insert. The oversheet extends over the substrate beyond the insert at least at one edge of the insert, preferably at two spaced substantially opposite edges straddling the insert, and optionally at three edges or all around the periphery of the insert. The size of the margins is not critical; within certain limits needed to affix the oversheet to the substrate and sufficiently to confine the insert.

At least certain of the margins contain an adhesive for affixing the oversheet to the substrate. These adhesive margins are sufficiently wide that an adequate quantity of adhesive can be deposited thereon to affix the oversheet to the substrate. The specific dimensions can vary with the size of the insert and the oversheet. For a typical folded insert, for example containing a folded manifold of two 8½ by 11 inch sheets printed on both sides and folded to a square of 2¾ inches on a side, two spaced margins of ½ to ¾ inch width can extend along the length of a rectangular oversheet that is rectangular and about 3 inches by 5 inches.

The width of the margins and the adhesive are preferably chosen to have the desired effect of either permitting the edge of the oversheet to be peeled up from the substrate or preventing the edge from being peeled up without tearing the oversheet. Either possibility can be provided. However, according to a preferred arrangement, the oversheet is intended to stay permanently affixed at the margins. The margins preferably are at least ⅛" wide, and more preferably are between ¼" to 1.0" wide, or more.

The oversheet is affixed to the substrate, preferably by an adhesive that may be deposited onto the margins of the oversheet prior to the disposition of the oversheet over the insert. In some embodiments, the margins of the oversheet may be affixed to the substrate by a peelable adhesive, which may be re-sealable. In the preferred arrangement discussed, the margins of the oversheet are affixed to the substrate by a permanent pressure-sensitive adhesive or an activatable adhesive that is rendered operative by contact with a material on the substrate. An example of an activatable adhesive is an adhesive that becomes tacky and active, i.e., causes adhesion, when wet, such as the adhesives used on many business mailing envelopes.

Examples of suitable permanent adhesives for the marginal edges of the substrate are aqueous and non-aqueous adhesives, resins and similar compositions that remain tacky, volatile resins and compositions that dry or cure by chemical reaction, acrylates, epoxies, silicone and other sealants, etc.

In some embodiments, a portion of the oversheet is removable, and may be removed, for example, along with the insert. It is also possible to facilitate tearing away of the oversheet, e.g., by providing perforations along the margins between a portion adhesively affixed to the substrate and a portion spaced from the substrate by the insert or otherwise. It is generally desirable to minimize or prevent damage to the substrate by, for example, lifting of fibers from the paper stock, removal of colored coatings, inks or illustrations, or other visible effect on material that may be printed or otherwise appear on the substrate.

However, destructive removal of the oversheet may be desired to obtain access to the insert. In such embodiments, the oversheet is affixed to the substrate by an adhesive at the margins of the oversheet, so as to capture the insert. The oversheet includes a main body and at least two margins, of which at least one is attached along a perforated line to the main body of the oversheet. The main body of the oversheet can then be removed by a user separating the main body from the affixed margin at the perforated line, thus exposing the insert, while leaving the associated margin of the oversheet affixed to the substrate.

In assemblies including such an oversheet having perforably attached margins, the oversheet may have an adhesive substantially covering the bottom surface of the oversheet, including both the margins and the main body of the oversheet. The main body of the oversheet, which contacts the insert, can have "inactivated" adhesive thereon. Inactivated adhesives may be referred to by those skilled in the art as "killed adhesives," and generally refers to an area at which an applied adhesive is no longer tacky. An adhesive can be reduced in tackiness or wholly inactivated as compared to its operative state, in known manner, depending on the nature of the adhesive. For example, a curable adhesive can be cured by application of the associated curing agent while not in contact with the substrate. An aqueous adhesive or one with a volatile carrier can be dried or evaporated when not in contact. Alternatively, any of these forms of adhesive can be coated to eliminate tackiness, for example by dusting the tacky area with talc or otherwise preventing adhesive contact.

In any event, according to a preferred arrangement, an uninterrupted adhesive layer preferably is applied substantially to the entire bottom surface of the oversheet, including the margins that are to be adhered to the substrate and also including the central area that is not to be adhered.

However, the adhesive in the central area is inactivated as described, and thus the oversheet can rest against the insert without substantial adherence or damage when separated.

For many embodiments, it is highly preferred that the insert be visible and identifiable as such through oversheet. Thus the oversheet preferably is a substantially transparent plastic sheet. By "substantially transparent" is meant that the insert over which the oversheet is disposed preferably is visible to the human eye through the oversheet and it the existence of printed text or images on the insert, if any, is discernable even if the text and images are not completely unobscured. In short, it is desirable for the insert to be sufficiently visible that the user can appreciate the nature of the insert, without the need for any supplemental instructional labeling on the substrate.

On the other hand, the oversheet need not be transparent or colorless or even translucent. The oversheet itself also could be printed. The oversheet preferably is made of a polymeric material that has sufficient flexibility and elasticity to be stretched over the insert and thus resiliently to bear down against the insert and to secure the insert against the substrate. In other embodiments, particularly in embodiments wherein an adhesive is present between the insert and the substrate, or less preferably between the insert and the oversheet, the oversheet may be made of a less stretchable polymeric material as polyester or oriented polypropylene.

Packages for which the insert assembly is useful include bottles, including glass and plastic bottles, cartons, cans, cylinders made of cardboard, paper, or metal, and tubes such as those commonly used for toothpaste and cosmetic products. Brochures and placards for use as substrates for the insert assemblies may be made of, for example, paperboard, laminated paperboard, with and without printing or other coatings, or plastic. Materials that are coated with a release material to which a given adhesive cannot attach, are obviously not preferred with that adhesive, and care should be given to choice of compatible materials for the substrate, adhesive and oversheet, as well as for any tacking adhesive for the insert, in known manner.

Leaflets for use as inserts according to the assemblies described herein are preferably in the form of a plurality of sheets or plies of a material that can be printed upon, particularly paper. The paper may be folded multiple times so that it assumes a configuration over which an oversheet may be placed and affixed. For example, the paper may be in booklet form, folded and bound together at the fold to form a spine of the booklet. Alternatively, the paper may be folded multiple times to form a number of panels or pages in an overlying relationship. Thus, the leaflet has two or more edges, preferably four edges, each of which may be independently folded, fixed as in a booklet spine, or free, i.e. unfolded. Preferably the leaflet when folded the leaflet is generally rectangular. Exemplary leaflet folding configurations suitable for use in the assemblies disclosed herein are described in U.S. Pat. Nos. 6,158,778 and 6,290,796.

The thickness of the leaflet is not critical; however, the practical upper limit to the thickness of the leaflet will be determined in part by the application for which the leaflet is intended. For example, if the leaflet is to be affixed to a cylindrical container such as a bottle, the leaflet is preferably sufficiently thin that it can conform to the shape of the container. A folded leaflet that is too thick may not be held in place sufficiently by the oversheet. A folded thickness from about ⅛ inch to about ⅜ inch may be advantageous. Commercially available sheet stock is suitable for use in making a leaflet.

Additionally, a leaflet containing many folded layers tends to fan open, particular for a time after initial folding, in the absence of a compressing force. One of the advantageous aspects of the oversheet according to the invention is that a certain amount of compression can be applied by pressing the oversheet over the insert on the substrate initially, because any tendency of the insert to fan open is transmitted into tension on the oversheet and is resisted after the margins of the oversheet are attached.

Product samples useful as inserts are preferably provided in a configuration that is adaptable to being affixed to substrate and covered with an oversheet. For example, product samples may be provided in an envelope, bag, or ampoule.

According to another aspect, the present invention concerns a novel method for making insert assemblies, particularly in that it is possible according to the invention to substantially simplify the complicated structures and handling steps needed to attach known envelope-like supplements to a substrate, by applying the envelope contents (the insert) directly to the substrate and holding it down using the oversheet techniques as described herein.

In a preferred embodiment, successive substrates such as promotional brochures, containers or the like are fed sequentially along a feed path to a feeder at which inserts are dispensed from a magazine directly onto the substrates. An exemplary substrate feeder for brochures is a comb wheel feeder, known to those skill in the art for transporting components from a first position to a second position for modification or processing. The comb wheel feeder may be mounted to dispense onto a conveyor belt or the like, whereby the fed brochures or other substrates are carried forward. When each substrate arrives at the dispensing point from the magazine of inserts, an insert is deposited onto the substrate. This can be accomplished by sensing the substrate mechanically or optoelectrically and feeding an insert, or simply as a matter of sequential conveyor indexing or timing wherein the inserts are incrementally fed at the same pitch that the brochures or other substrates are carried along the conveyor.

In the embodiment shown in FIG. 1, for example, the substrates are brochures fed along a horizontal conveyor belt to a point directly under a magazine that dispenses single inserts in sequence with incremental advance of a continuously moving conveyor belt. Other feeding and handling arrangements are possible, such as a conveyor that move in an indexing motion, substrates engaged by carriers or conveyor receptacles, and other specific arrangements that should be readily apparent.

Optionally, a spot of a mild adhesive, such as a Fugitive Hot Melt (mucilage rubber cement adhesive), may be deposited onto the substrate and/or the insert before the insert is deposited onto the substrate. This is useful as a temporary means of affixation, as well as a technique to retain the insert under the preferred form of oversheet, which does not enclose around all the sides of the insert and preferably only is attached to the substrate on two spaced marginal edges straddling the insert on opposite sides.

After the insert is deposited onto the substrate, preferably with a spot of fugitive hot melt for tacking, the oversheet is deposited onto the insert and substrate. The insert has at least three edges, and preferably has two pairs of edges, i.e. the insert is preferably rectangular in form and has four edges in two perpendicular spaced pairs. If the insert is a leaflet, and the leaflet has two or more plies, one of the edges of the leaflet is folded and the opposite edge tends to fan open. The folded edge preferably is the leading edge because the arrangement will be passed under compression rollers as it moves along the conveyor.

The oversheet has a top or outer surface, and a bottom or inner surface that contacts the substrate (at the margins of the oversheet) and the insert (in a middle part of the oversheet between the margins). The oversheet is deposited onto the insert such that the oversheet has a main body contacting the insert and one or more portions extending outside two of the edges of the insert and contacting the substrate. A portion of the oversheet that extends outside the edges of the insert is referred to herein as a margin, and preferably the oversheet has two margins that extend outside and straddle the insert, where the margins contact and adhere to the substrate. At least one of the margins preferably is connected to the main body of the oversheet along a perforation line. As discussed hereinabove, the main body and margins of the oversheets may have an adhesive on their bottom surface contacting the substrate, which adhesive has been deactivated or at least minimized in the area that contacts the insert.

After the oversheet is deposited onto the insert, pressure preferably is applied to secure the oversheet onto the substrate, to compress the insert if necessary, and generally to positively assemble the respective parts in their final arrangement. Pressure to secure the oversheet onto the substrate need only be applied substantially along the margins of the oversheet that bear against the substrate. However, additionally, pressure is preferably applied to the oversheet generally over its surface, including the margins and the central area, to compress the insert as well as the whole assembly. Such compression may be particularly desirable, for example, when the insert is a folded, multi-ply leaflet that tends to fan open. The pressure to secure the oversheet onto the substrate and/or the pressure to compress the insert may be provided by one or more rollers.

In a preferred embodiment, the oversheets are arranged in a manner similar to plastic labels and can be fed and applied over substrates and the inserts thereon using an automatic label applicator such as are available from Booth Manufacturing Co. t/a Autolabe, Fort Pierce, Fla. An advantageous form of label applicator employs a web of successively spaced labels on a carrier web or belt, for example plastic sheet labels on a paper stock web having a release coating. The carrier web is passed around the sharp bend of a reversing path at the point of application of the labels. The sharp bend causes the individual labels to be lifted from the web and dropped onto the substrate and the insert thereon. This stack, consisting essentially of a substrate (e.g., a glossy printed brochure), the insert resting on the substrate (e.g., a folded product information sheet), and the oversheet with the central body part laid over the insert and the adhesive margins residing directly over the substrate, is then rolled flat, permanently bonding the margins directly to the substrate.

Figure 2:
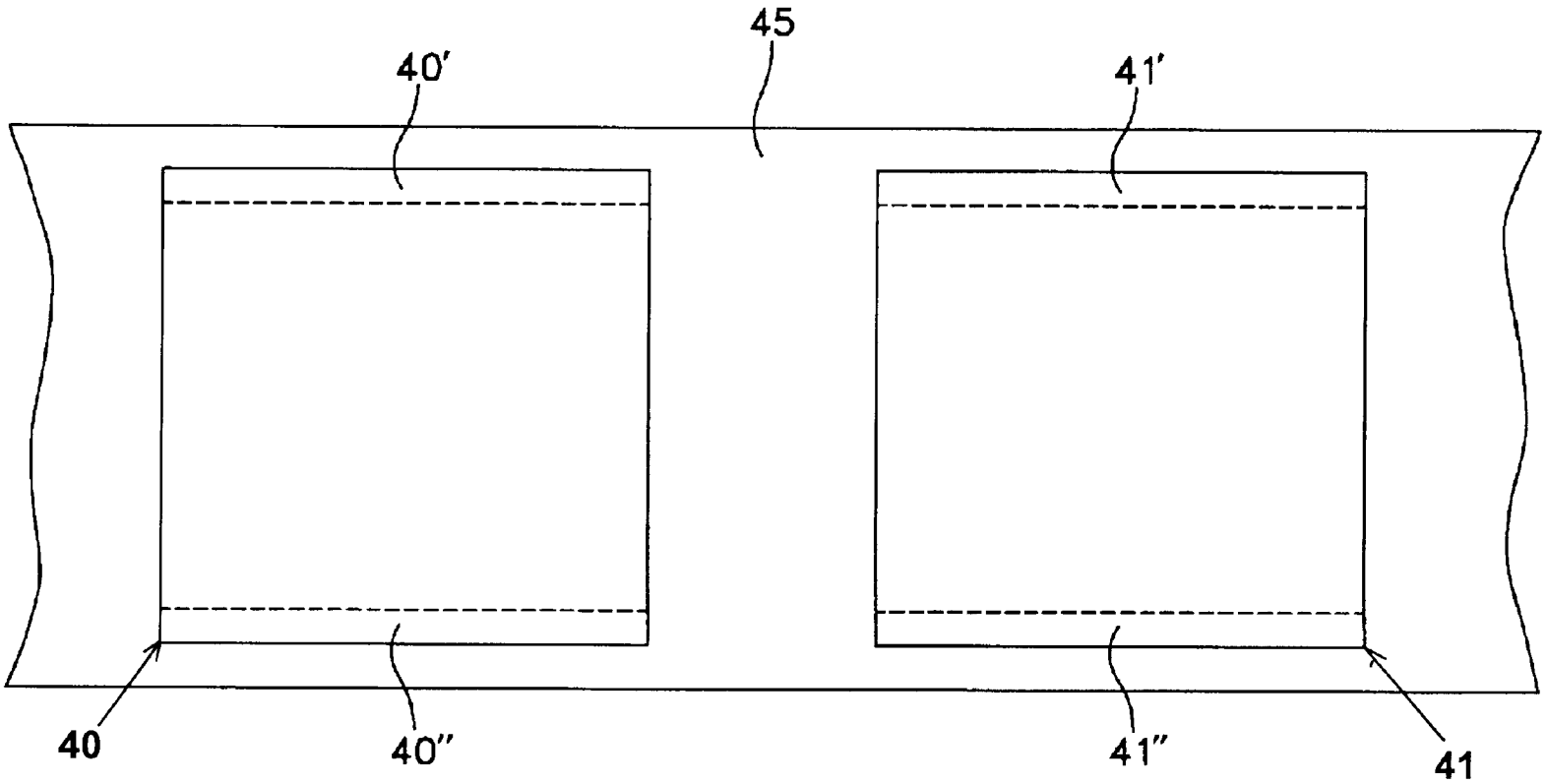
FIG. 2 is a top view of a web of oversheets for use in making insert label assemblies according to one embodiment of the invention.

A preferred embodiment for depositing the insert and oversheet onto a substrate is illustrated schematically in FIG. 1. A magazine of inserts 100 is located above belt 11. Belt 11 transports substrate 12 in the direction shown. A insert 10 is deposited onto substrate 12, optionally with a dab of fugitive hot melt to fix the insert in place on the substrate. Delivery roller 13 carries a web 15 of oversheets around detachment roller 24, producing a sharp bend or fold 25 in the web 15 of oversheets. A top view of a web 45 of oversheets is shown in FIG. 2. Oversheets 40 and 41 have margins 40', 40", 41' and 41". Margins 40', 40", 41' and 41" are affixed to web 45 by an adhesive (not shown) that is readily detachable, for example due to an appropriate release coating that prevents the adhesive bearing margins of the oversheets from adhering permanently to the web.

As the web passes around the bend or fold 25, the leading edge of the oversheet 26 tends to continue along rather that to fold back with the web, and as a result the oversheet peels away from web 15. The oversheet is thus deposited onto substrate 12. Web 15 is carried to a web return roller 16 where it is accumulated for disposal. Substrate 12 is carried to a position beneath adhesive attachment rollers 17, 18, 19,17', 18' and 19'. In the illustrated embodiment three pairs of rollers are shown. However, the number of adhesive attachment rollers is not critical, and one pair of rollers may be used. The pairs of rollers are disposed such that the rollers contact and compress each adhesive bearing margin of oversheet 26, thus permanently affixing the margins directly to the substrate a positions that straddle the insert. The adhesive attachment rollers help to secure oversheet 26 to substrate 12, and particularly if the insert is fanning open, may initially be the cause for the margins to come into contact with the substrate. Substrate 12 bearing insert 10 and oversheet 26 is then carried to a position beneath compression roller 30 that generally compresses the assembly. Compressor roller 30 is optional, but is useful to compresses insert 10 and to tighten the assembly and better affix the oversheet margins to the substrates securely. The compression roller also eliminates unnecessary thickness in a stack of assembled insert-bearing substrates.

Figure 3B:
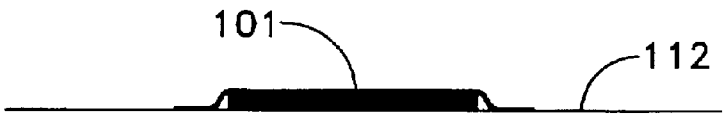
FIG. 3 is a cross-sectional view of an insert label assembly according to one embodiment of the invention.
Figure 3A:
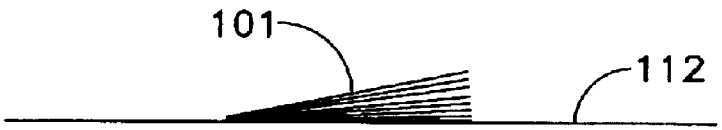

Thus as shown in FIG. 3(*a*), before application of the oversheet and before compression, a leaflet 101 placed upon and preferably tacked to substrate 112, even though folded, is somewhat expanded. In FIG. 3(*b*), the leaflet 101 has been compressed by application of the oversheet (not shown) and, by roller pressure, such that the leaflet is substantially compressed, flat and captive under the oversheet, which is securely and compactly affixed to the substrate, enabling easy stacking and/or packing.

Various modifications, in addition to those described herein, will be apparent to those skilled in the art from the foregoing description. Such modifications are intended to fall within the scope of the appended claims.

What is claimed is:

1. An insert assembly comprising:

a substrate;

an insert having a back surface disposed toward said substrate and a front surface disposed opposite from said substrate;

an oversheet, having at least three edges, a bottom surface disposed toward said insert, and a top surface disposed away from the insert, said oversheet overlying said insert such that said insert is disposed between said substrate and said oversheet;

said oversheet affixed to said substrate at least at two of said edges such that said insert may be removed from between said substrate and said oversheet while said oversheet remains affixed to said substrates;

a first adhesive material on the bottom surface of said oversheet, said first adhesive material contacting said substrate and the front surface of said insert;

wherein said first adhesive material contacting said front surface of said insert is inactivated.

2. The insert assembly of claim 1, wherein said oversheet is substantially rectangular in shape and has two pairs of opposing edges, and is affixed to said substrate at one of said pairs of opposing edges.

3. The insert assembly of claim 1, wherein said oversheet is made from a polymeric material.

4. The insert assembly of claim 1 wherein said substrate is a package.

5. The insert assembly of claim 1 wherein said substrate is formed from a material selected from the group consisting of matte paper, laminated paper, paperboard, and polymeric materials.

6. The insert assembly of claim 1 wherein said insert is a leaflet bearing text, images, or text and images.

7. The insert assembly of claim 1 wherein said insert is a product.

8. An insert assembly comprising:

a substrate;

an insert having a back surface disposed toward said substrate and a front surface disposed opposite from said substrate;

an oversheet, having at least three edges, a bottom surface disposed toward said insert, and a top surface disposed away from the insert, said oversheet overlying said insert such that said insert is disposed between said substrate and said oversheet;

said oversheet affixed to said substrate at least at two of said edges such that said insert may be removed from between said substrate and said oversheet while said oversheet remains affixed to said substrate;

further comprising a first adhesive material on the bottom surface of said oversheet, said first adhesive material contacting said substrate and the front surface of said insert; and, wherein said oversheet comprises a main body and two or more margins perforably connected to said main body, and said first adhesive material on the bottom surface of said main body of the oversheet is inactivated.

9. The insert assembly of claim 8 wherein said package is selected from the group consisting of a paperboard box, a glass bottle, a plastic bottle, and a disposable tube.

10. An insert assembly comprising:

a substrate;

an insert having a back surface disposed toward said substrate and a front surface disposed opposite from said substrate;

an oversheet, having at least three edges, a bottom surface disposed toward said insert, and a top surface disposed away from the insert, said oversheet overlying said insert such that said insert is disposed between said substrate and said oversheet;

said oversheet affixed to said substrate at least at two of said edges such that said insert may be removed from between said substrate and said oversheet while said oversheet remains affixed to said substrate;

a first adhesive material on the bottom surface of said oversheet, said first adhesive material contacting said substrate and the front surface of said insert; and, on said back surface of said insert, a second adhesive.

11. A method for making an insert assembly, comprising:

providing a substrate;

providing a magazine containing inserts, each insert having a back surface, a front surface, and at least three edges;

feeding said substrate so that said substrate is disposed adjacent to said magazine in a position for receiving a insert from said magazine;

depositing onto said substrate one or more inserts from said magazine such that the back surface of said insert contacts said substrate;

depositing onto said insert and said substrate an oversheet having a top surface and a bottom surface, such that said oversheet extends beyond two of said edges of said insert and a portion of said bottom surface of said oversheet contacts said substrate: and, further comprising inactivating at least a portion of said adhesive material.

12. The method of claim 11 herein said insert is substantially rectangular in shape and has two pairs of opposing edges, and wherein said oversheet is deposited onto said insert and substrate such that the oversheet extends beyond said insert at one pair of opposing edges.

13. The method of claim 11 wherein said oversheet has disposed on said bottom surface an adhesive material.

14. The method of claim 11 wherein said oversheet comprises a main body and at least two margins perforably connected to said main body, and wherein said adhesive on the bottom surface of said main body is inactivated.

* * * * *